United States Patent [19]

Rudoy

[11] Patent Number: 5,030,133

[45] Date of Patent: Jul. 9, 1991

[54] CONNECTOR WITH ATTACHED CAPS

[75] Inventor: Edward Rudoy, Woodland Hills, Calif.

[73] Assignee: ITT Corporation, New York, N.Y.

[21] Appl. No.: 557,858

[22] Filed: Jul. 25, 1990

[51] Int. Cl.[5] ..... H01R 4/24

[52] U.S. Cl. ..... 439/409

[58] Field of Search ..... 439/389–425

[56] References Cited

U.S. PATENT DOCUMENTS 3,971,616 7/1976 Hashimoto ..... 439/410

4,413,872 11/1983 Rudy, Jr. et al. ..... 439/410

*Primary Examiner*—Joseph H. McGlynn

*Attorney, Agent, or Firm*—Thomas L. Peterson

[57] ABSTRACT

An insulation displacement connector is described, of the type wherein caps are used to press wires against insulation displacement contacts projecting from opposite faces of a body, which is simple and of low cost. The caps (32, 34 FIG. 1) are integrally molded with the body (12), with thin joints (36, 38) connecting them, the joints being broken when the caps are moved towards opposite faces of a middle wall of the body. The joints can be formed as living hinges, and the caps are first pivoted 90° and then broken before being pressed towards opposite faces of the body wall.

15 Claims, 5 Drawing Sheets

FIG. 2
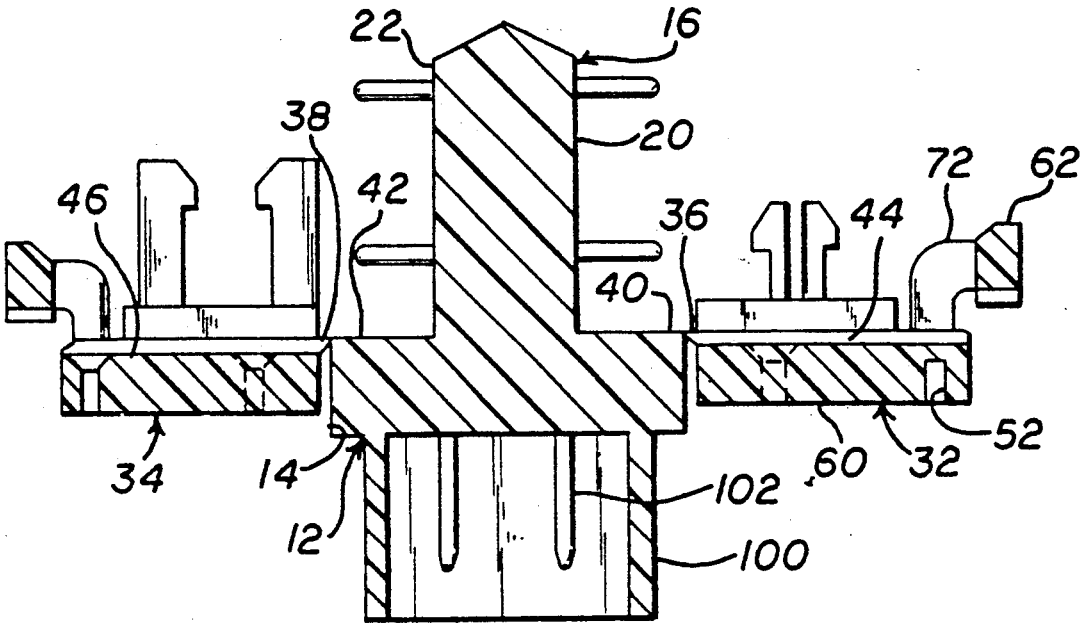
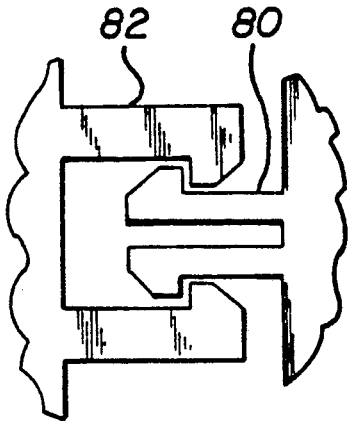
FIG. 7

CONNECTOR WITH ATTACHED CAPS

BACKGROUND OF THE INVENTION

One type of connector that uses contacts with insulation displacement ends, includes a body with a face from which the contact ends project, and a cap that presses insulated wires into the contact ends. When the cap has been pressed far enough to assue reliable termination of the wires, the cap is automatically latched in place to the body. Additional parts may be required to clamp the wires to the body for strain relief. If the number of parts that have to be molded and separately handled could be reduced, the cost of such connectors could be reduced and the reliability increased.

SUMMARY OF THE INVENTION

In accordance with one embodiment of the present invention, an insulation displacement connector is described, of the type that includes contacts with insulation displacement ends projecting from a face of a body wall, and at least one cap that is pressed towards the face to terminate wires to the contact ends, which can be constructed at low cost. The cap is molded integrally with the body, with a thin joint between them that is intended to be broken when the cap is pushed towards the body wall face.

The body wall can include two opposite faces from which the contact ends project, and two caps can be used to press two groups of wires against the opposite faces of the walls. Each cap has a latch at each of its ends, and as the caps are pushed to their final positions, corresponding latches on the two caps lock together, to thereby lock the caps in place on either side of the body wall. Each cap can include a cover part that presses the wires in place, and a wire support spaced from an edge of the cover part by approximately the thickness of the wires. A deflecting surface on the body deflects the wire supports closer to the cover part as the cap reaches its fully installed position, to thereby provide strain relief.

The novel features of the invention are set forth with particularity in the appended claims. The invention will be best understood from the following description when read in conjunction with the accompanying drawings.

BRIEF DESCRIPTION OF THE DRAWINGS

FIG. 2 is a sectional view of the connector of FIG. 1.

FIG. 7 is a view of the area 7—7 of FIG. 4.

DESCRIPTION OF THE PREFERRED EMBODIMENT

Figure 1:
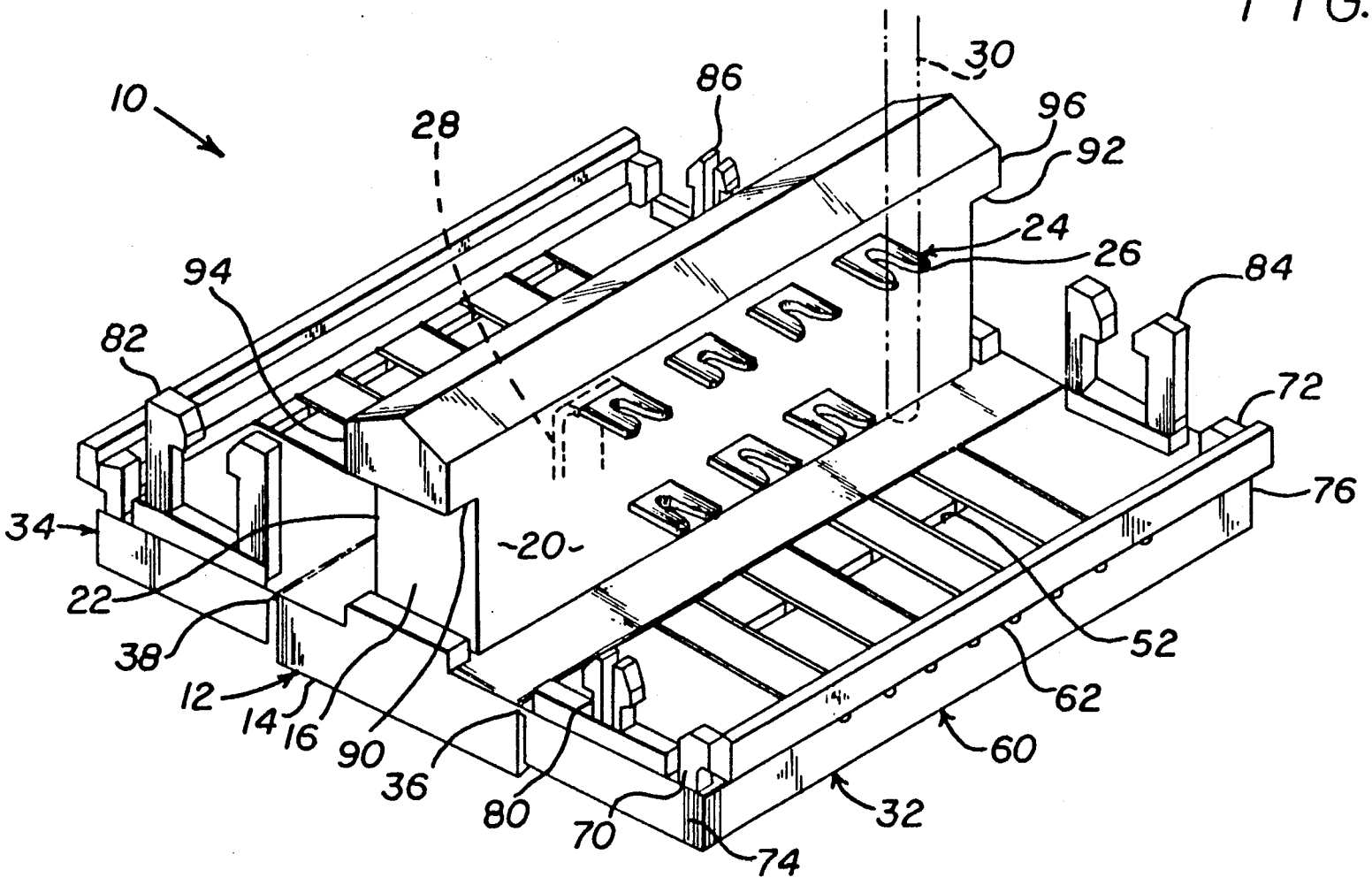
FIG. 1 is a perspective view of a connector constructed in accordance with one embodiment of the present invention, shown as molded.

FIG. 1 illustrates a connector 10 of the present invention, which includes an insulative body 12 having a base portion 14 and a middle wall 16 extending upwardly from the base portion. The middle wall has opposite faces 20, 22. A plurality of contacts 24 have insulation displacement ends 26 projecting in two rows from each face of the wall, and have mounting portions 28 held in the body as by inserting them in place. Wires such as shown at 30 are pressed into the contact ends so the contacts can displace wire insulation and engage the central conductor of each wire, by the use of caps 32, 34. It should be noted that directions such as "vertical", "horizontal", and the like are used herein only to aid in the description of the drawings, and the connector and its parts can have any orientation with respect to gravity.

As shown in FIG. 2, the caps 32, 34 are molded integrally with the body 12. Each cap has a lower or inner edge portion 36, 38 where it is connected to a location 40, 42 on the body that is spaced, a distance from an adjacent face 20, 22 of the middle wall. The edge portions 36, 38 form living hinges that can be easily broken.

Figure 3:
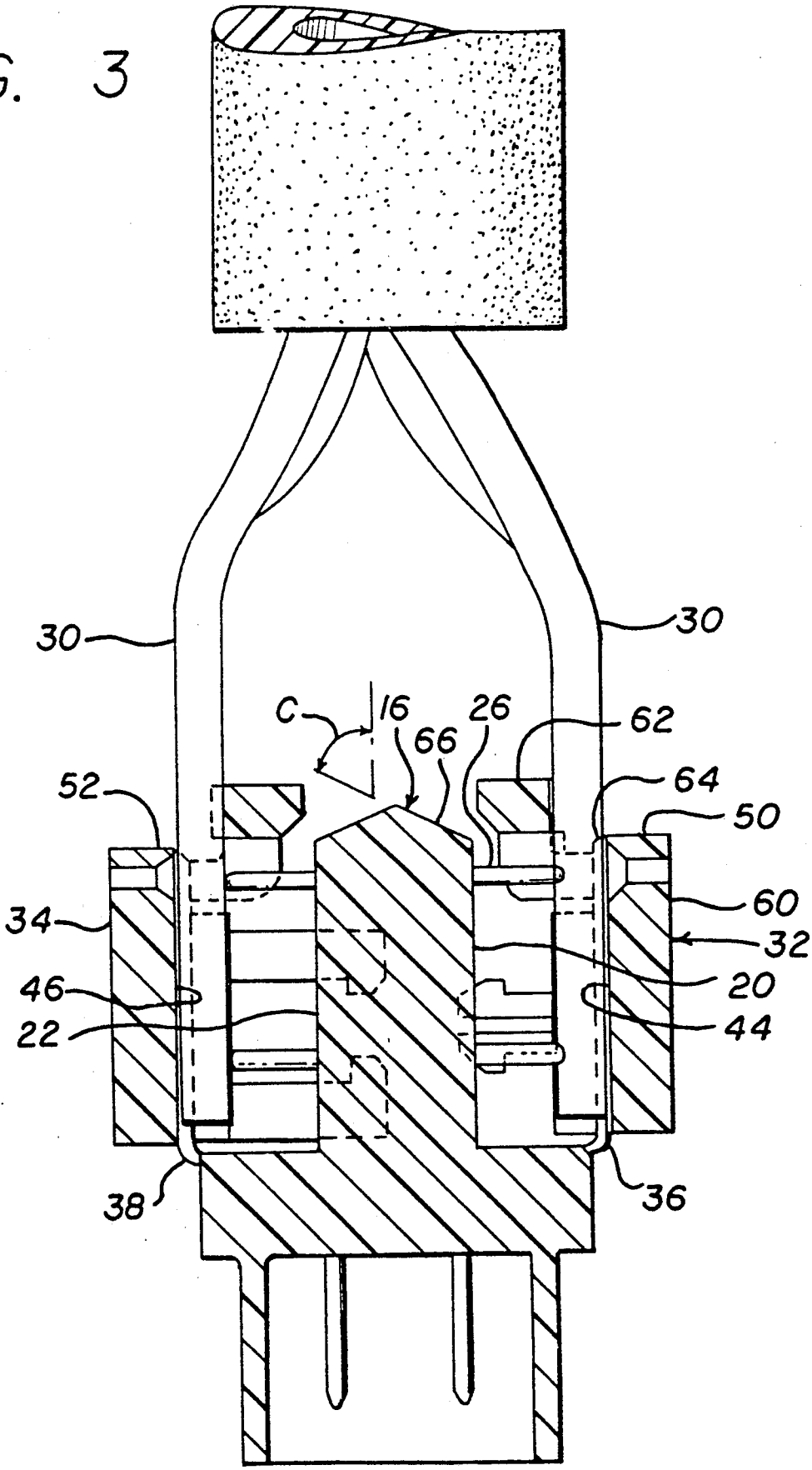
FIG. 3 is a view similar to that of FIG. 2, but with the caps pivoted 90° from their initial position, and with wires positioned between the caps and opposite faces of the body wall.

The caps have wire pressing surfaces 44, 46 that are initially horizontal. A first step in the assembly of the connector is to pivot the caps approximately 90° about their living hinges 36, 38 to the orientation shown in FIG. 3. In FIG. 3, the wire pressing surfaces 44, 46 of the caps are vertical and the outer sides or edges 50, 52 of the caps lie above the living hinges. With the caps in this orientation, the wires 30 can be placed between the cap surfaces 44, 46 and the contact ends which project from the faces 20, 22 of the middle wall 16. The wires can be in the form of two ribbon cables, split ends of a single ribbon cable, or other type of wire arrangement.

Figure 4:
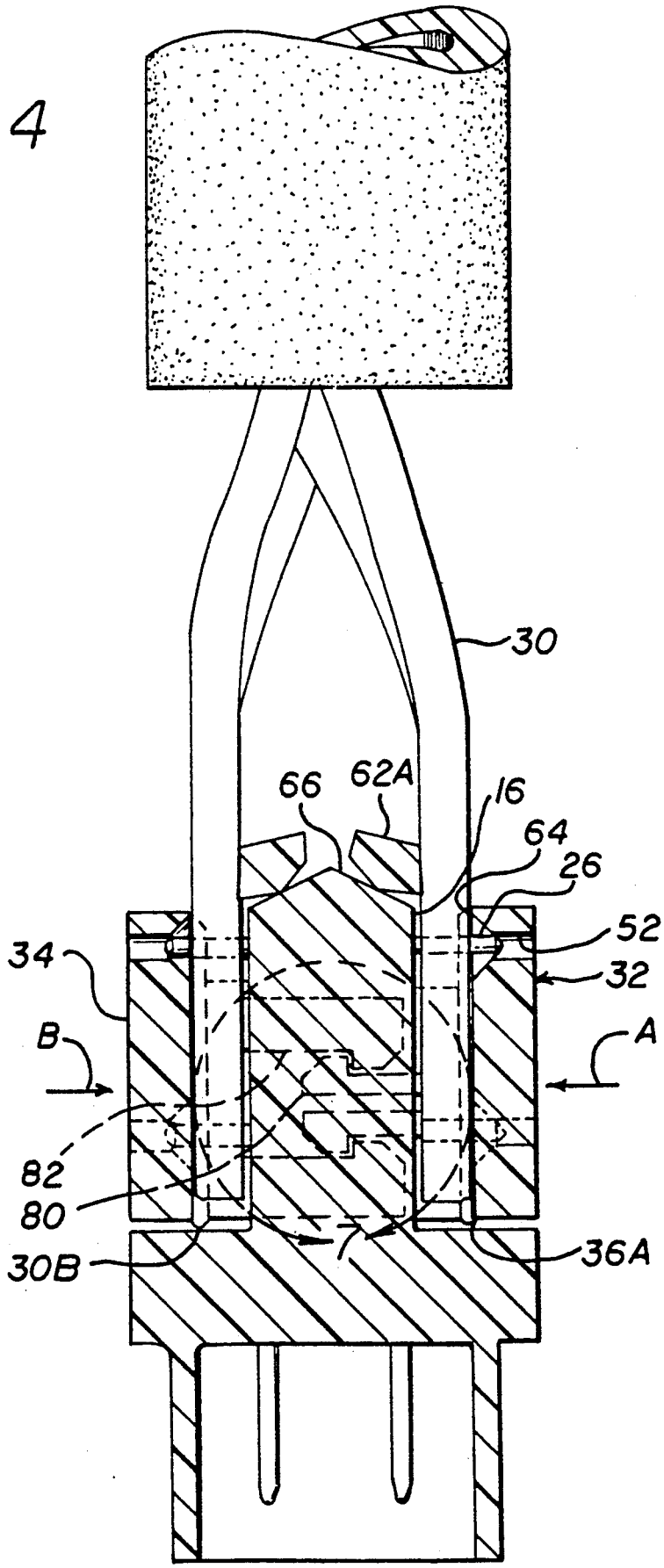
FIG. 4 is a view similar to FIG. 3, but with the caps and wires in fully installed positions.
Figure 5:
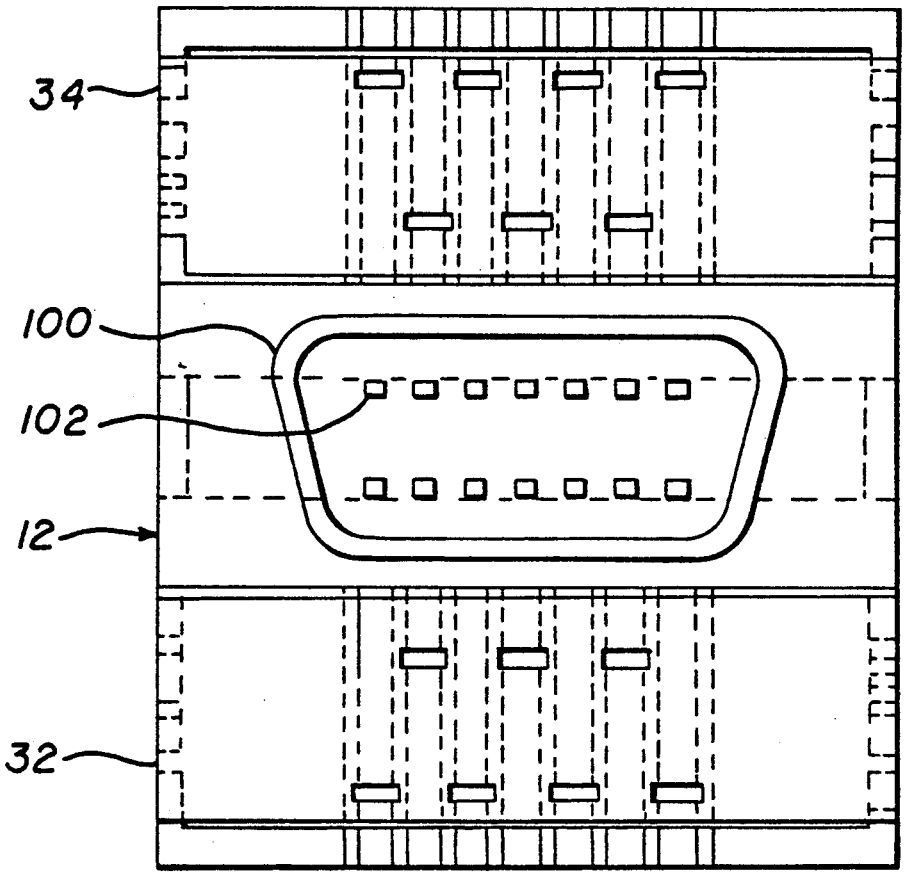
FIG. 5 is a bottom view of the connector of FIG. 2.
Figure 6:
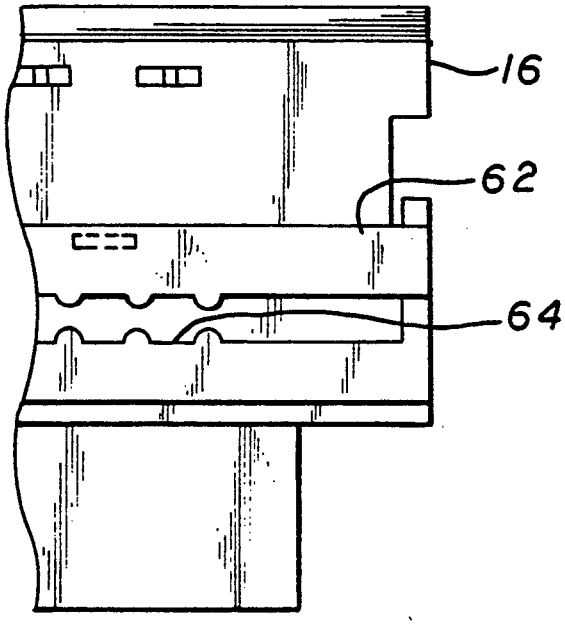
FIG. 6 is a partial side elevation view of the connector of FIG. 2.

The next step, shown in FIG. 4, is to press the caps 32, 34 in the horizontal directions A, B towards the middle wall 16, with sufficient force to break the living hinges to leave broken cap edge portions 36A, 36B. Such movement of the caps also causes them to push the wires 30 into the contact ends 26 to terminate the wires to the contacts. The contact ends enter slots 52 in the caps which help secure the contacts. When the caps have been pushed to their final positions, the caps are latched in place so they cannot be pulled away from the middle wall 16 of the body.

Each cap such as 32 (FIG. 3) includes a cover part 60 forming the opposite edges or sides such as 36, 50, and also includes an elongated wire support 62 extending substantially parallel to the upper cover part side 50. The wire support is spaced from the side 50 of the cover part by a distance approximately equal to the thickness of the wire 30. With the caps pivoted up, the wires 30 are installed by threading them through the gap or space 64 between the wire support and cover part edge. When a cap such as 32 is pressed against the middle wall 16 as shown in FIG. 4, the wire support at 62A is deflected by a deflecting surface 66 on the middle wall 16, to reduce the size of the gap 64. This results in the wire 30, being squeezed between the wire support 2A and the cover part edge 50. Such squeezing of the wire provides strain relief, in that pulling of the wire upwardly is first resisted by the squeezed part of the wire in gap 64 instead of the terminated part that engages the contact end 26.

Although it would be possible to orient the deflecting surface 66 vertically, (when the middle wall 16 is vertical as in FIG. 3) applicant prefers to orient the surface 66 at an angle C of at least 30° from the vertical. This results in gradual deflection of the wire support 62 during considerable (more than 20%) of the horizontal travel of the cap.

The wire support 62 (FIG. 1) is held on the cover part 60 of the cap by a pair of elongated arms 70,72 that extend from opposite ends 74,76 of the cover part to the wire support. The arms 70,72 are elongated and bendable, to permit deflection of the wire support. The length of each wire support between a pair of arms 70, 72 at its opposite ends, is greater than the length of each row of contact ends 26, so all of the group of wires at one face of the middle wall are supported (and squeezed as described below).

When the two caps are pressed against opposite faces of the middle wall 16 of the body, the caps are securely latched or locked in place by a latching mechanism that includes four latches 80, 82, 84, 86 that are mounted at the opposite ends of the cover parts of the caps. The opposite ends of the middle wall have cutouts 90, 92 that permit the latches to pass therethrough and lock to one another to lock the caps to each other. The middle wall cutouts leave flanges 94, 96 that prevent vertical movement of the latches relative to the body.

As mentioned above, applicant initially molds the connector in the configuration shown in FIG. 2, wherein the middle wall 16 extends vertically and the cover parts 60 of the caps extend horizontally (i.e. at right angles). This relative orientation of the body and caps facilitates molding of the connector in a single piece. For example, parts of the mold that fill the slots, 52 which eventually hold the contact ends, extend vertically, in the same direction as the walls surrounding the lower contact ends 102 that form pins for mating to another connector. It would be possible to originally mold the caps in the orientation shown in FIG. 3, although this would generally result in a more complicated and more expensive mold. In any case, by molding the caps 32,34 integrally with the body 12 on the connector, applicant minimizes the number of separate parts that have to be molded and handled, which reduces the cost of the connector and simplifies cable termination.

Thus, the invention provides an insulation displacement connector which can be constructed at low cost. The connector includes an insulative body having a wall with at least one face from which contact ends project, and at least one cap having an edge portion connected to the body, with the edge portion being breakable to allow the cap to be moved towards the wall face to terminate the wires to the contacts. The connector generally includes two caps with latches on the two caps that engage one another when the caps are pressed toward the opposite faces of the middle wall, with the caps locking to one another to hold themselves securely to the body. Each cap can include a cover part with a surface that presses the wires in place, and with an elongated wire support spaced from an edge of the cover part by approximately the thickness of the wire. The wire is threaded between the wire support and cover part before the cap is pressed into its final position. As the cap is pressed to its final position, a deflecting surface on the middle wall deflects the wire support closer to the corresponding edge of the cover part, to squeeze the wire between them, so as to provide strain relief.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An insulation displacement connector for connecting to a plurality of wires that each has a central conductor and insulation about the conductor, comprising:

and insulative body having a wall with as least one face;

a plurality of contacts mounted in said body and having insulation displacement ends projecting from said wall face;

at least one cap that has a cover part that can press toward said wall face to press a group of said wires toward said contact ends projecting from said wall face;

said cap having an edge portion connected to a location on said body lying a distance beyond said wall face, said edge portion being breakable to allow said cap be moved toward said wall face to press said wires into said contact ends.

2. The connector described in claim 1 wherein:

said edge portion connecting said cap to said body, with said body and said cap with a living hinge molded as a single piece with said cap cover part extending in a plane that lies perpendicular to middle wall face.

3. The connector described in claim 1 wherein:

said wall has opposite faces and a group of said contact ends project from each of said faces;

said body has a base portion with opposite base portion edges spaced from said wall faces:

said at least one cap includes a pair of caps, each having thin edge portion connected to one of said base portion edges and being breakable.

4. The connector described in claim 1 wherein:

said cap includes a cover part having opposite sides and opposite ends and a surface for pressing said wire into said contact ends, and said cap also has an elongated wire support extending substantially parallel to one of said cover part sides and spaced therefrom by about the thickness of one of said wires, said wire support being deflectable toward the cover part side;

said body has a deflecting surface positioned to engage said wire support and deflect it closer to a corresponding side of said cover part to squeeze the wire lying therebetween, as the cap is moved towards the body wall, whereby to provide strain relief.

5. The connector described in claim 4 wherein:

said deflecting surface is angled by at least 30° from a direction parallel to said wall face.

6. The connector described in claim 1 wherein:

each of said caps has opposite end portions and has a latch at each of said end portions projecting towards a corresponding latch on an end portion of the other cap, with each latch of a pair of corresponding latches constructed to lock to the other latch as said caps press said wires fully into said contact ends.

7. The connector described in claim 6 wherein:

said middle wall has opposite ends and has a flange portion at the top of each end;

the pair of latches on each cap are positioned to pass beneath said flange portions, whereby the flange portions hold the caps in place.

8. An insulation displacement connector for connecting to a plurality of wires that each has a central conductor and insulation about the conductor, comprising:

an insulative body having a base portion and a middle wall extending upwardly from said base portion, said middle wall having opposite faces;

a plurality of contacts mounted in said body and having insulation displacement ends projecting from said faces of said middle wall;

a pair of caps that each has a cover part that can press toward a different one of said middle wall faces to press a group of said wires toward said contact ends projecting from the corresponding face of said middle wall;

each of said caps has opposite end portions and a latch at each end portion positioned to project toward a corresponding latch at the end portion of the other cap as the caps are pressed towards opposite faces of said middle wall, said latches constructed so each latch of a cap locks to a corresponding latch on the other cap as said caps press said wires fully into said contact ends.

9. The connector described in claim 8 wherein:

said middle wall has opposite ends and has a flange portion at each of its ends;

said latches are positioned to pass beneath said flange portions as said caps are pressed together, so the flange portions hold down said caps when they have been pressed together.

10. The connector described in claim 8 wherein:

said body and caps are integrally molded, with said base portion of said body having opposite sides and each cap having a side lying adjacent to a side of a base portion joined thereto by a breakable joint, said joints preventing said caps from pressing said wire into said contact ends until said joints are broken.

11. The connector described in claim 8 wherein:

said cover parts each have a side and said caps each have an elongated wire support spaced from said cover part side by substantially the thickness on one of said wires, each cover part and each wire support having opposite ends and each cap having a pair of arms with each arm joining an end of said cover part to an end of said wire support;

said contact ends are arranged in a plurality of rows and the length of each wire support between the arms at its ends, is greater than the length of any of said rows of contact ends.

12. The connector described in claim 11 wherein:

said middle wall has deflecting surfaces that engage said wire supports to deflect them closer to a corresponding one of said cover part sides, as said caps are pressed towards said middle wall faces, whereby to squeeze the wires to provide strain relief.

13. A method for terminating two groups of wires to contact insulation displacement ends that project from opposite faces of a middle wall of a body, by positioning each of said groups of wires between one face of said wall and the cover part of one of a pair of caps, and pressing the caps toward the wall faces, comprising:

initially molding said body and said caps integrally and with a breakable joint between them;

breaking said joints and moving said caps towards said wall faces.

14. The method describes in claim 13 wherein:

said step of molding includes forming said joints as living hinges, and forming said cover parts with largely flat surfaces extending perpendicular to said wall faces; and including pivoting said caps about said living hinges until said cover part surfaces lie substantially parallel to said middle wall faces, before breaking said joints.

15. The method described in claim 13 wherein:

said cover parts each have an inner side adjacent to a corresponding one of said joints and an opposite outer side, and each cap has an elongated wire support spaced from the outer side of the cover part of the cap by about the thickness of one of said wires;

said middle wall has deflecting surfaces;

said step of pressing the caps includes pressing each wire support against a corresponding one of said deflecting surfaces and deflecting the wire support closer to the corresponding cover part side as said caps are pressed, whereby to provide strain relief.

* * * * *